US010788294B2

(12) United States Patent
Goodson et al.

(10) Patent No.: US 10,788,294 B2
(45) Date of Patent: Sep. 29, 2020

(54) BALLISTIC RESISTANT LAMINATE PANEL

(71) Applicants: Raymond Lynn Goodson, Sandy, UT (US); William Edward Gatti, Sandy, UT (US); Shari L. Futas, Long Beach, CA (US); Lucretia A. Lake, Cypress, CA (US)

(72) Inventors: Raymond Lynn Goodson, Sandy, UT (US); William Edward Gatti, Sandy, UT (US); Shari L. Futas, Long Beach, CA (US); Lucretia A. Lake, Cypress, CA (US)

(73) Assignees: Mitigation 3, LLC, Salt Lake City, UT (US); Pi 8 Solutions, Inc., Bosque Farms, NM (US)

( * ) Notice: Subject to any disclaimer, the term of this patent is extended or adjusted under 35 U.S.C. 154(b) by 0 days.

(21) Appl. No.: 15/548,075

(22) PCT Filed: Feb. 1, 2016

(86) PCT No.: PCT/US2016/016021
§ 371 (c)(1),
(2) Date: Aug. 1, 2017

(87) PCT Pub. No.: WO2016/123632
PCT Pub. Date: Aug. 4, 2016

(65) Prior Publication Data

US 2018/0245886 A1 Aug. 30, 2018

Related U.S. Application Data

(60) Provisional application No. 62/110,538, filed on Feb. 1, 2015.

(51) Int. Cl.

| | |
|---|---|
| ***F41H 5/04*** | (2006.01) |
| ***E04H 9/06*** | (2006.01) |
| ***E04H 9/10*** | (2006.01) |

(52) U.S. Cl.
CPC ..... *F41H 5/0428* (2013.01); *F41H 5/0421* (2013.01); *F41H 5/0457* (2013.01); (Continued)

(58) Field of Classification Search
CPC ..... F41H 5/0457; F41H 5/0428
See application file for complete search history.

(56) References Cited

U.S. PATENT DOCUMENTS 5,059,467 A * 10/1991 Berkovitz ..... F41H 5/0485 2/102
H1061 H * 6/1992 Rozner ..... B32B 15/08 89/36.02

(Continued)

OTHER PUBLICATIONS

Unified Facilities Criteria (UFC), Design to Resist Direct Fire Weapons Effects, p. 61-66, 2017 (Year: 2017).*

*Primary Examiner* — Liam J Heincer
(74) *Attorney, Agent, or Firm* — Brent M. Burningham

(57) ABSTRACT

A ballistic resistant, fragmentation debris capture laminate panel is comprised of one or more ballistic resistant and containment materials that have been laminated together with one or more thermoplastic resin substrates such as polycarbonate and/or PETG. The ballistic resistant, fragmentation debris capture laminate panel can be manufactured with a variety of ballistic resistant and containment materials, by autoclave or hot press methods, and include decorative and/or image bearing appearance. Specifically, a ballistic resistant laminate, fragmentation debris capture panel of the present invention can be manufactured to include materials, such as aramid fiber sheet, ballistic ceramic products, and/or metal fabric sheet, or combination thereof, to meet one or several ballistic resistant standards and fragmentation debris capture ratings selected by the user for a specific building, construction or structural application.

13 Claims, 2 Drawing Sheets

(52) U.S. Cl.
CPC ..... *F41H 5/0478* (2013.01); *E04H 9/06* (2013.01); *E04H 9/10* (2013.01)

(56) References Cited

U.S. PATENT DOCUMENTS 5,200,256 A * 4/1993 Dunbar ..... B32B 15/14 428/212
5,376,426 A * 12/1994 Harpell ..... F41H 5/0457 428/105
5,958,539 A * 9/1999 Eckart ..... B32B 27/12 428/46
5,998,028 A * 12/1999 Eckart ..... B32B 27/36 428/383
6,133,169 A * 10/2000 Chiou ..... A41D 31/0061 428/911
6,684,404 B2 * 2/2004 Bachner, Jr. ..... F41H 1/02 2/2.5
2003/0080248 A1 * 5/2003 Morgan ..... F41H 5/0457 244/118.5
2003/0192426 A1 * 10/2003 Peretz ..... B32B 17/10018 89/36.02
2004/0053040 A1 * 3/2004 Goodson ..... B32B 27/12 428/326
2006/0252328 A1 * 11/2006 Bingenheimer ..... B32B 5/12 442/180
2007/0144111 A1 * 6/2007 Kennedy ..... B32B 5/26 52/783.17
2008/0307553 A1 * 12/2008 Jbeili ..... F41H 5/0428 2/2.5
2009/0114083 A1 * 5/2009 Moore, III ..... F41H 5/0421 89/36.02
2009/0169855 A1 * 7/2009 Tunis ..... F41H 5/0414 428/293.4
2010/0098929 A1 * 4/2010 Dispenza ..... B29C 45/14778 428/292.1
2010/0107860 A1 * 5/2010 Dobesberger ..... B22D 25/005 89/36.02
2010/0107862 A1 * 5/2010 Schulte ..... F41H 5/0478 89/36.02
2011/0048219 A1 * 3/2011 Pyles ..... E04C 2/20 89/36.01
2011/0162515 A1 * 7/2011 St. Claire ..... F41H 5/0457 89/36.02
2011/0239851 A1 * 10/2011 Mason ..... B32B 27/04 89/36.02
2011/0296979 A1 * 12/2011 Howland ..... B32B 3/16 89/36.02
2012/0090452 A1 * 4/2012 Sudhakar ..... B29C 70/46 89/36.02
2016/0102471 A1 * 4/2016 Grieves ..... B32B 9/002 428/215
2017/0082405 A1 * 3/2017 Lualdi ..... F41H 5/0442

* cited by examiner

BALLISTIC RESISTANT LAMINATE PANEL

CROSS-REFERENCE TO RELATED APPLICATIONS

The present invention claims the benefit of priority to U.S. Provisional Patent Application No. 62/110,538, filed on Feb. 1, 2015, entitled "Ballistic Resistant Laminate Material," the entire contents of which are incorporated by reference herein.

BACKGROUND OF THE INVENTION

1. Field of the Invention

The present invention relates generally to bullet resistant material, and more particularly to architectural panels of such material, protection from penetration by high-power, high-caliber ammunition, and capture of bullet and blast fragmentation debris. This invention also relates to decorative or image-bearing material capable of use in architectural design, image simulation and camouflage.

2. The Relevant Technology

There are many structures where the type of organization occupying the premises requires greater protection and security from firearm or incendiary blast attack, in addition to design considerations. Such targets may include government offices, financial institutions, government contractors, community centers, public transportation areas such as airports, subways, train and bus terminals, hotels, stadiums and homes of high profile individuals.

Government buildings, military installations, corporate offices, hotels and upscale private residences have need for added security. With existing levels and threats of terrorism, war, and violent crime, protection from firearm assault is an important consideration in such environments. Additionally, existing ballistic resistant materials are limited in their ability to withstand shots from higher caliber ammunition and/or blast fragmentation debris. Further, existing bullet resistant, fragmentation debris capture materials are relatively utilitarian in nature and generally detract from the buildings in or around which they are installed.

Because traditional steel armor is very heavy, and not particularly attractive, a variety of alternative ballistic resistant materials have been created. Specialized glazing has been an important product in this category. Glass can be tempered, strengthened by heat or chemicals, or annealed. It can be colored through tinting. However, glass is limited in the spectrum of strengths, surface treatments and colors available. Further, glass is by nature transparent, and dense, making it very heavy in regard to size and building applications that are the subject of the present invention.

As an alternative to glass, acrylic has been used for bullet resistant, fragmentation debris capture applications. It is lighter than glass, and can be transparent or colored. However, when struck or penetrated, acrylic is prone to shatter when used alone, or to delaminate when used together with other materials.

Polycarbonate has also been a favored bullet resistant, fragmentation debris capture material, alone or laminated with glass. Polycarbonate is favored for its high impact strength and melting temperature, and excellent fragmentation debris capture. It excels as a shield for blasts; however, it is limited in its bullet-stopping specific strength.

In the realm of personal security, aramid fibers—made famous by the DuPont Kevlar® brand of fiber, have spawned a host of lightweight, bullet resistant apparel, accessories and protective gear. Aramids are a group of aromatic polyamide materials characterized by their light weight while being very strong and heat-resistant. These synthetic materials are capable of being formed into fibers, filaments or sheets.

Multiple layers of these aramid woven sheets such as Kevlar®, are, alone, most suitable for lighter weight body armor applications and other protective gear worn by police, military and other security forces. They are not effective for barrier, architectural, and construction applications due to insufficient structural strength and durability.

A variety of ceramic compositions have been proven to be excellent ballistic resistant materials. Common ceramic armor is made from boron carbide, silicon carbide, and aluminum oxide. Another ceramic, aluminum oxynitride or ALON, is useful for making transparent armor, such as goggles and windshields.

While each of the materials described above have some ballistic resistant fragmentation debris capture properties on their own, combinations thereof, particularly combinations capable of including metal components integral to the composition are uncommon. Further, materials made from combinations of the above materials, specifically tailored or customizable to meet published reference standards of ballistic resistance, are presently unavailable.

Thermoplastic resin architectural panels have become established as versatile materials for use in bringing color, texture and image-based design elements into modern construction, including retail, hospitality and other premises where design considerations are significant. Such panels are produced in typical construction panel sizes of 4'×8' to 4'×12', by positioning the materials to be laminated in layered fashion, one on top of another, in large laminating presses.

Fabrication of this type is disclosed in U.S. Patent Application US 2011/0048219 A1 entitled Blast-Resistant Barrier, which discloses hot press fabrication using polycarbonate sheets, and U.S. Pat. No. 7,940,459 B2 entitled Formable Fused Polymer Panels Containing Light Refracting Films, which discloses hot press and autoclave fabrication including the use of bonding films. In each fabrication environment, the materials to be bonded are heated to a temperature sufficient to exceed the melting temperature of the thermoplastic resin and/or the specific bonding films or membranes being used. These temperatures and techniques are known to those familiar with the art. It is an object of the present invention to adapt these techniques to the needs of ballistic resistant materials as disclosed herein.

Protective gear and materials are measured with respect to their ability to withstand the impact of standard test ammunition rounds. One standard for measuring protective capacity is the National Institute of Justice ("NIJ") Standard for Ballistic Resistant Protective Materials, Standard 0108.01. It rates armor according to a scale from Type I to Type IV, and a special user-defined special requirement category. Test rounds used to confirm Type I level ballistic resistant material are exemplified by .22 caliber long rifle and .38 Special ammunition. Type III test uses a Remington 700 rifle and 24" (0.6 m) barrel with 7.62 NATO 147 grain FMJ ball ammunition while Type IV ammunition is exemplified by 30-06 M-2 armor-piercing (AP) ammunition. In tests of Type I through Type III, the sample must stop 5 rounds without failure. In Euro7 the 5.56 mm ammunition is tested with a Remington 700 rifle and 20" (0.5 m) barrel with 62 grain AP round and the target test sample must stop 5 rounds without failure. In Type IV, the sample must stop a single round, and must be capable of stopping a single round of any lesser type as well. All testing was qualified to meet the most stringent requirements for US and European standards.

In addition, HP White publishes a standard HPW-TP 0500.02 specifying 5 levels of ballistic protection beginning with Level A 0.38 Special Round Nose Lead and culminating at Level E 30.06 AP M2 rounds, 3 rounds each respectively. All ammunition was tested in accordance with these standards and specified velocities without failure.

In addition, ASTM International publishes a ballistic standard, ASTM F-1233 specifying 6 levels of ballistic protection beginning with 9 mm Parabellum/Submachine gun and culminating with 12 gage Shotgun Shell, 3" Magnum and 30.06 AP, 3 rounds each respectively. All ammunition was tested in accordance with these standards and specified velocities without failure.

In addition, the Underwriters Laboratory ("UL") publishes a ballistic standard, Standard 752. Internationally, the European Committee for Standardization has created standards DIN EN 1063, concerning ballistic glass, and DIN EN 1522/1523, concerning ballistic windows, doors, shutters and blinds, which together form a ballistic classification system applied to armored vehicles and structures. The UL Standard 752 specifies resistance to eight (8) levels of handgun and rifle ammunition and two (2) types of shotgun ammunition, whereas the Euro standard 1063 specifies resistance to seven (7) levels of handgun and rifle ammunition and two (2) levels of shotgun ammunition.

A further, related standard is Mil-Std-662F 1997, a military standard that determines the ballistic limit of the tested material, denoted as the V50 ballistic limit. The V50 ballistic limit is an expression in meters per second (m/s) of the conditions wherein there is an equal probability of ammunition or debris being contained within the material or passing through. The V50 ballistic limit is based on analysis of outcomes of projectiles fired at a target to simulate the velocity of fragmentation or debris caused by blast or ballistic events, including the lowest velocity at which a specified projectile fully penetrates a target, and the highest velocity at which the specified projectile only partially penetrates a target. In addition by accepted industry practice and by similitude, fragmentation and debris elements with lower ballistic coefficients than tested ammunitions will also fall within ballistic limit and containment capability experimentally established for each material.

What is needed, and the object of the present invention, is a robust, resilient bullet resistant material, customizable to be capable of stopping even the most high-velocity or special purpose armor-piercing rounds subject to these industry standards, and capable of doing so in an aesthetically pleasing and functional manner while meeting or exceeding stringent NIJ, UL, ASTM, HP White and EURO ballistic resistant standards and meeting or exceeding V50 ballistic limit and by similitude, fragmentation capture ratings.

What is further needed, and a further object of the present invention, is that a panel fabricated according to the present invention be user-customizable to meet one or more specified criteria, including the level of ballistic resistance, budget, and appearance of the resulting panel by utilizing a combination of dissimilar ballistic resistant materials, ranging from laminates of thermoplastic materials to laminates of thermoplastic materials with aramid fiber sheets or metal sheets, or combination thereof.

It is therefore a principal object and advantage of the present invention to provide a bullet and fragmentation resistant barrier that meets the high ballistic resistance standards established by recognized authorities.

It is a further object and advantage of the present invention to provide a bullet resistant barrier that may be constructed using a combination of dissimilar materials to the specification of the user based on the anticipated threat level.

It is an additional object and advantage of the present invention to provide a bullet resistant barrier that may optionally be fabricated with integral decorative appearance.

It is yet an additional object and advantage of the present invention to provide a bullet resistant barrier that may be fabricated with a minimum of dissimilar materials and with a minimum of manufacturing steps.

Other objects and advantages of the present invention will in part be obvious, and in part appear hereinafter.

SUMMARY OF THE INVENTION

The present invention provides an effective means for stopping bullets from small-caliber and from high-caliber firearms, including fragmentation particles. Further, the present invention comprising a laminate of bullet resistant components is an effective shield from other projectiles, including blast fragmentation debris. The present invention is a multi-layered laminate panel comprising at least a first thermoplastic resin layer bonded to at least one additional ballistic resistant material layer.

The group of additional ballistic resistant materials to be bonded to the first thermoplastic layer is comprised of additional thermoplastic resin sheets, aramid fiber sheets, ceramic material, and metal fabric sheets. In the case of bonding aramid fiber sheets, ceramic material, or metal fabric sheets in a ballistic resistant material of the present invention, the aramid sheet, ceramic material or metal fabric sheet are encapsulated by placing a second thermoplastic resin sheet opposite the first thermoplastic resin sheet, with the aramid sheet, ceramic material or metal fabric sheet (collectively "non-thermoplastic layer") positioned between them. For purposes of this application, the composition resulting from the at least one thermoplastic layer, and one or more non-thermoplastic layers bonded between the first and a second thermoplastic resin layer is called a module.

The thermoplastic resin sheets may be selected from any resin capable of thermoforming, preferably polycarbonate or polyethylene terephthalate glycol ("PETG"). In the case of bonding adjacent thermoplastic resin layers, the use of TPU may be required to bond dissimilar materials, such as bonding a polycarbonate sheet to a PETG sheet, or when bonding a polycarbonate sheet to module wherein the thermoplastic layer of the module is a PETG sheet. The thermoplastic resin sheets may be selected according to the desired performance of the module, or the nature, number or configuration of ceramic material or metal fabric layers to be included in the module.

A first thermoplastic resin layer may also be bonded to a module, wherein the thermoplastic selected and used in the module may be the same as or different than the thermoplastic used in the first or second thermoplastic resin layer. Accordingly, a bonding layer may be required between a first or second thermoplastic resin layers, as in the case of bonding polycarbonate sheets to one another, or to other thermoplastic resin sheets.

The one or more non-thermoplastic layers may be one or more aramid sheets, one or more ceramic materials, one or more metal fabric sheets, or combinations thereof.

Aramid sheets may be laminated between PETG sheets to form a PETG-aramid sheet component. These PETG-aramid sheet components may be further laminated to one another or to other layers in a ballistic-resistant laminate panel using a bonding layer.

All dissimilar layers, incapable of mechanical bonding or chemical bonding on their own when subjected to adequate heat, pressure and vacuum, are bonded to one another by placing a bonding layer, comprising an adhesive, sheet, membrane or film between the layers and subjecting the assembly to heat, pressure and vacuum for prescribed periods. The bonding layers preferred in the present invention comprise thermoplastic polyurethane ("TPU"), polyvinyl butyral ("PVB"), or the like, such materials being known to those skilled in the art.

The one or more metal fabric sheets of a module may be selected from a woven wire screen, coiled wire sheet, chain mail or the like. An advantage of a metal fabric of these types is that each possesses a three-dimensional open matrix or scaffold around which the thermoplastic resin material may flow and mechanically bond without the use of additional bonding layers. The metal fabric layer of the module is mechanically bonded between the resin layers under sufficient heat to cause the surface of the resin layers adjacent the metal fabric to flow in the spaces between metal fibers or links, as the case may be. When cooled the resin solidifies to form a mechanical bond between the resin layers and the metal fabric.

The number, selection and arrangement of metal fabric layers within the material may be adjusted to achieve desired performance criteria. A second or additional metal fabric layers may be added. When a plurality of metal fabric layers are present in the same module, they may optionally be separated from one another by interior resin sheets. The interior resin sheets may be any resin capable of thermoforming, preferably polycarbonate or PETG.

When multiple metal fabric layers are present in a module, the orientation of the weave of the second or additional fabric layers may be adjusted by rotating between 1 and 90 degrees with respect to the weave of a first metal fabric layer. Similarly, a module having a metal fabric with a weave oriented in one direction may be laminated or mechanically fastened to a second module with a weave oriented in a different direction.

Each single layer of ballistic resistant material, or module, comprising an element of the resulting laminate panel possesses a certain ballistic resistance rating on its own. These layers, when combined impart a ballistic resistant and fragmentation capture character that is cumulative, and in some cases synergistic when compared to the resistance of the sum of the parts. Thus, ballistic resistant materials of the present invention may be user selected to be combined according to known or measurable ballistic resistant standards and ratings to create a finished laminate panel having a specified target ballistic resistance rating.

A robust table of leading industry ballistic standards, arranged by promulgating organization, is provided in the U.S. Department of Defense publication "Unified Facilities Criteria (UFC)—Design to Resist Direct Firer Weapons Effects" further identified as UFC 4-023-07, with original and change dates of 7 Jul. 2008, and Change 1, 1 Feb. 2017. Promulgating Organizations and their respective standards set forth in Appendix C thereof include the following standards referred to throughout the application: ASTM F 1233, European Standard (Euro) DIN EN 1063, HP White Laboratories HPW-TP 0500.02, National Institute of Justice (NIJ) 0108.01, and Underwriters Laboratories (UL) 752.

Each standard presents several ballistic resistance ratings within the standard, ranging from 9 mm pistol small arms to .50 caliber rifle ammunition, and shotgun categories. Those ratings of particular interest to the present invention are those associated with high caliber rifle munitions, specifically those related to 30.06, including armor piercing (AP), collectively referred to as 30.06: 5.56 mm, including NATO and AP, collectively referred to as 5.56; and 7.62 mm, including NATO and AP rounds, collectively referred to as 7.62. The complete table found in UFC 4-023-07 Appendix C, and familiar to those of ordinary skill in the art, is incorporated by reference.

As will be noted, through either mechanical or chemical bonding, the first thermoplastic resin layer may be bonded to one or more additional ballistic resistant materials or ballistic resistant modules to create an end product having a few or numerous layers. The final bullet resistant material may optionally comprise a single module, multiple modules, or no modules, according to the target bullet resistance rating.

Optionally, one or more decorative layers may be added to the material as part of the manufacturing process. The decorative layers may be selected from compatible decorative films, sheets or constructed panels, such as those available from 3 form, Inc. (Utah, USA). Such constructed panels may also comprise wood veneers, surface textures or other visual elements well known to those familiar with the art. Images may also be pressed, printed or painted onto the ballistic resistant material of the present invention.

The optional decorative layer may be an image useful to either accentuate the bullet resistant, fragmentation debris capture material, to camouflage it, or to meet other visual design specifications. More specifically, it is possible that an installation of the bullet resistant, fragmentation debris capture material could be designed and installed to resemble the appearance of a building interior or exterior material, and be used to mimic the construction and appearance of a structure, and protect the structure and its occupants. Alternatively, the bullet resistant, fragmentation debris capture material could be fabricated with a decorative layer and incorporated as a distinct design element of a structure while achieving its purpose as a protective barrier. As a further alternative, the decorative layer could be substituted for the one of the exterior resin layers to obtain the thinnest possible module complete with decorative layer.

The ultimate formability of the finished panel is impacted by the type of metal fabric selected to be embedded within a module. In the event a coiled wire screen is used, the finished article may be able to be formed with curvature in one dimension only, perpendicular to the length of the coiled wires. Those with rigid wire screen may be limited only to planar panel construction.

In compositions incorporating decorative layers, the layer forming the decorative element may be in any position within the composition where its features may be visible. Most typically, the decorative element will be the layer adjacent the exterior polycarbonate layer, or in lieu of a second polycarbonate layer. In materials having multiple decorative layers, the decorative layers may be positioned opposite one another adjacent the exterior layers so as to present a different appearance on one side of the bullet resistant material from that visible on the other side of the bullet resistant material.

In a first embodiment, the invention comprises a first exterior polycarbonate layer, a multi-layer interior region comprising a module having at least one aramid fiber sheet, and an optional second exterior polycarbonate layer. The exterior polycarbonate layers and interior module are fused together with a bonding film comprising TPU or PVB. Those experienced in the art of laminating dissimilar materials will be familiar with these and suitable substitutes for these bonding materials. The ballistic resistant material of the first embodiment is user-selected to possess a ballistic resistance rating sufficient to defeat typical small caliber ammunition.

In a second embodiment, the invention comprises a module having a first exterior polycarbonate layer, a metal fabric interior layer, and a second exterior polycarbonate layer. No additional bonding materials are required. The ballistic resistant material of the second embodiment is user-selected to possess a ballistic resistance rating sufficient to defeat select types of higher caliber ammunition, as well as typical small caliber ammunition.

In another embodiment, the invention comprises a first exterior polycarbonate layer, a multi-layer interior region, and an optional second exterior polycarbonate layer. The multi-layer interior region comprises an aramid fabric module and a metal fabric module. The exterior polycarbonate layers and interior modules are fused together with TPU. The ballistic resistant, fragmentation debris capture material of this third embodiment is user-selected to possess a ballistic resistance rating sufficient to defeat select types of higher caliber ammunition, as well as typical small caliber ammunition.

In yet another embodiment, the invention comprises a first exterior polycarbonate layer, a metal fabric module wherein the weave of the metal fabric is aligned parallel with the length of the material, and a second metal fabric module wherein the weave of the metal fabric is oriented perpendicular to the length of the panel and the weave of the metal fabric layer in the first metal fabric module, a second exterior polycarbonate layer, and a decorative image layer. The exterior polycarbonate layers and the interior metal fabric modules are fused together without the use of additional bonding materials or layers. The ballistic resistant, fragmentation debris capture material of this embodiment is user-selected to possess a ballistic resistance rating sufficient to defeat a broader range of higher caliber ammunition, as well as typical small caliber ammunition.

Materials of the present invention comprising functional and optional decorative layers, when combined provide a variety of ballistic resistant, fragmentation debris capture and visual design variables. The material can be assembled in panels for use as fixed or mobile barriers useful for the protection of persons and property.

These exemplary embodiments, derivatives and combinations thereof, limited only by the user-selected protective performance criteria, and the user-selected visual design criteria, will be appreciated by those skilled in the art.

BRIEF DESCRIPTION OF THE DRAWINGS

The present invention is better understood with reference to the accompanying drawings and detailed description wherein.

DETAILED DESCRIPTION OF A PREFERRED EMBODIMENT

The preferred embodiment of the present invention is disclosed herein and in the accompanying drawings. It comprises a ballistic resistant laminated material formed of a first polycarbonate exterior sheet, laminated together with at least one layer of metal fabric, and a second polycarbonate exterior sheet, the entire structure bonded together without the use of any bonding catalyst by applying heat to create a mechanical bond between the exterior polycarbonate sheets and the interior metal fabric, under environmental conditions of heat, pressure and vacuum known to those skilled in the art.

The metal fabric, preferably a coiled wire mesh having a weave of between 3/32 inches (0.2 cm) and 5/8 inches (1.6 cm) and wire in corresponding gauges of between 20 and 15 (diameters of between 0.0318" (0.8 mm) and 0.08" (2.0 mm)), respectively. The wires are preferably made of steel, which may optionally be treated with an alternative finish. Examples of alternative steel finishes include copper cladding, galvanizing, nylon coating, and aluminum coating. Further coiled wire may be of stainless steel, titanium, brass, nickel, copper or aluminum. Wires of these non-steel materials may be particularly useful in customizing the appearance of the finished product.

The number of metal fabric layers, and the orientation of their weave relative to one another, may be selected independent of one another to obtain a finished product meeting specific performance criteria according to the MIL, Euro, ASTM, HP White, UL or NIJ standards, or customized to a special custom user-specified standard. It is preferable that the metal fabric be of the coiled wire mesh type, as it has proven to have superior ability to deflect a bullet and facilitate bullet capture within the material. Further, a selection of one or more optional additional ballistic resistant materials may be added to the laminate panel. Such optional additional ballistic resistant materials may be selected from the group of thermoplastic resin sheets, aramid sheet modules, and decorative layers to meet user-selected performance specifications and aesthetic design criteria.

EXAMPLES

The following example is presented to illustrate the invention and should not be construed to limit the scope of the invention.

1. Single Metal Fabric Modules

Figure 1:
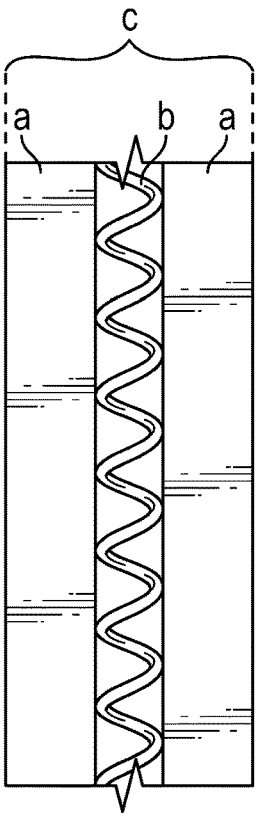
FIG. 1 is a cross-section view of a block of the ballistic resistant laminate panel in the form of a metal fabric module as described in detail as Example 1 below.
Figure 2:
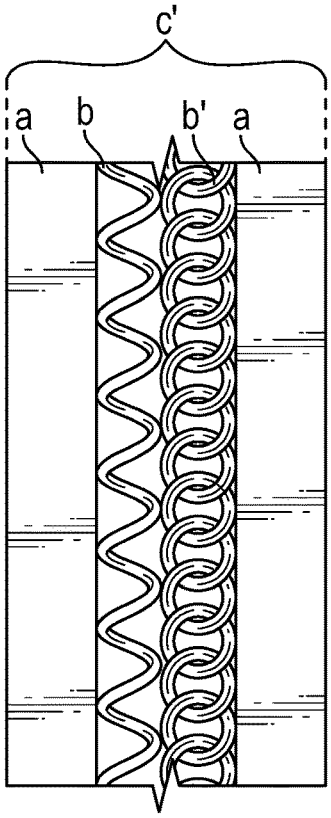
FIG. 2 is a cross-section view of a block of the ballistic resistant laminate panel in the form of a metal fabric module as described in detail as Example 2 below.
Figure 3:
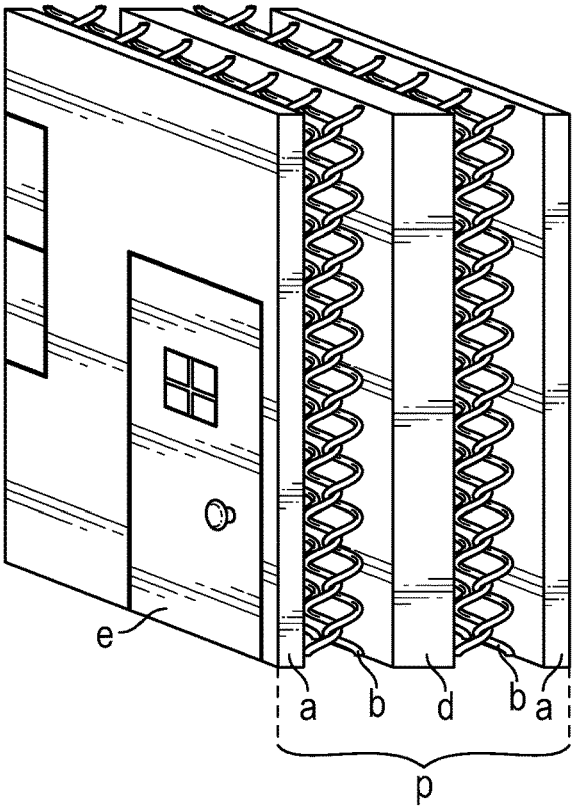
FIG. 3 shows a partially separated perspective view of a ballistic resistant laminate panel of the present invention described in detail as Example 3 below.

A preferred embodiment of the present ballistic resistant laminate panel of the present invention is disclosed by FIG. 1. In this example, the first layer of the laminate is a first polycarbonate sheet (a) with a thickness of one-half inch (½") (1.3 cm). The second layer is a metal fabric layer (b) wherein the metal fabric is coiled wire mesh. The third layer is a second polycarbonate sheet (a) of one-half inch (½") (1.3 cm) thickness. A panel of the present example, comprising two thermoplastic resin layers encapsulating a dissimilar ballistic resistant material, is what is called a module. In this example the dissimilar ballistic resistant material is a metal fabric, so this module is, more particularly, a metal fabric module (c). This exemplary lay-up results in a metal fabric module (c) having a thickness of approximately one inch (1") (2.5 cm), and a V50 rating of 1250 m/s.

This same lay-up, substituting thicker polycarbonate sheets (a) results in metal fabric module (c) having a thickness of 1.5" (3.8 cm) overall and a V50 of 1650 m/s with respect to a 1 oz. (28.4 g) 0.12 gauge slug. By substituting still thicker polycarbonate sheets (a) the metal fabric module (c) having a thickness of 3.5" (8.9 cm) has a V50 rating of 3200 m/s.

2. Double Metal Fabric Module

In a preferred embodiment of the present invention, a ballistic resistant laminate panel was constructed to meet the NIJ Type IV and armor piercing ratings which material comprised a first polycarbonate sheet (a), a first and second metal fabric layers (b), (b') with the second metal fabric sheet (b') in a plane adjacent to the first metal fabric sheet (b) but having an orientation rotated 90 degrees from the orientation of the first metal fabric sheet (b), and a second polycarbonate sheet (a) laminated as follows: a ¼" (0.6 cm) polycarbonate sheet (a); a first coiled wire mesh (b); a second coiled wire mesh (b'); and a ¼" (0.6 cm) polycarbonate sheet (a).

In a variant of this preferred embodiment, wherein the metal fabric is coiled wire mesh, the metal fabric layers (b) and (b') are compressed so that they become nested together, whether in parallel or rotated orientation, reducing the overall finished thickness of the ballistic resistant laminate panel, and imparting an increase in ballistic resistant, fragmentation debris capture properties to the module, more particularly the double metal fabric module (c').

3. Divided Double Metal Fabric Module with Image

Another preferred embodiment of the ballistic resistant, fragmentation debris capture laminate panel (p) was constructed to meet the NIJ Type IV and armor piercing ratings which material comprised two polycarbonate layers and two metal fabric layers, and laminated and decorated as follows:

¼" (0.6 cm) polycarbonate sheet, unadorned (a);
A first coiled wire mesh (b);
¼" (0.6 cm) PETG sheet (d);
A second coiled wire mesh (b);
½" (1.3 cm) polycarbonate sheet (a), on which is printed an image (e) of a building façade segment.

Preferred embodiments of the type disclosed by this example 3 were tested against NIJ 0108.01 Type III; UL 752 Levels 7 and 8; Euro DIN EN 1063 BR5, BR6, and BR7; and ASTM-F-1233 7.62 NATO ballistic resistant standards.

Another variation of the preferred embodiment of the ballistic resistant, fragmentation debris capture laminate panel in a divided double metal fabric configuration may optionally be achieved by laminating, with the addition of a layer of TPU between them, two metal fabric modules (c) of FIG. 1 as described in Example 1 above.

4. Combination Ballistic Resistant Laminate Panel

Figure 4:
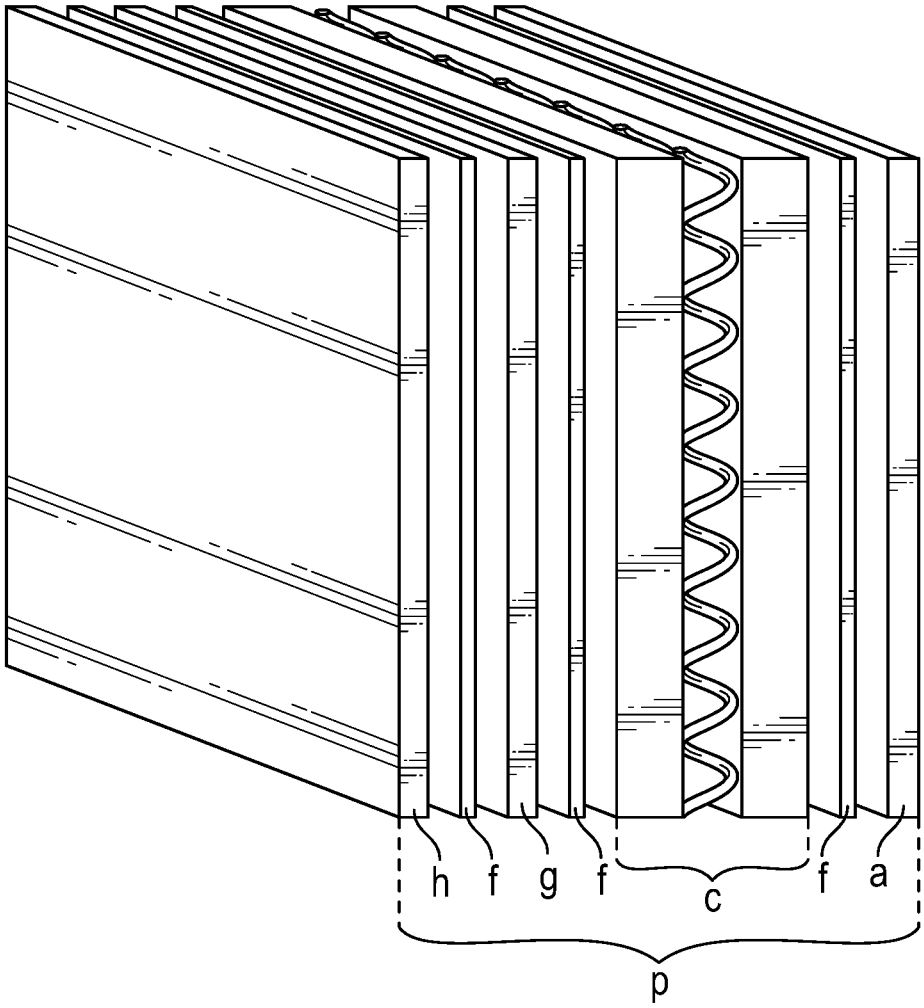
FIG. 4 shows a partially separated perspective view of a ballistic resistant laminate panel of the present invention described in detail as Example 4 below.

A generic sample lay-up of the ballistic resistant laminate panel (p) of the present invention is disclosed by FIG. 4, as follows:

a first polycarbonate sheet (a);
a TPU membrane (f);
a metal fabric module (c);
a TPU membrane (f);
an aramid sheet module (g);
a TPU membrane (f); and
a decorative thermoplastic layer (h).

The decorative thermoplastic layer may be any compatible thermoplastic sheet decorated with an image or comprising a decorative thermoplastic panel further comprising compatible films, sheets, or decorative interlayers.

5. Material Comprising Alternating Metal Fabric and Aramid Sheet Modules

Following the above stated principles, a ballistic resistant, fragmentation debris capture laminate panel was constructed to meet the NIJ Type IV, HP White HP Level E and ASTM 30.06 AP standards. This panel comprised a first polycarbonate sheet (a), three pairs of alternating metal fabric (c) and aramid sheet modules (g) wherein the thermoplastic resin in each module was PETG, and having a final layer of a second polycarbonate sheet (a). The polycarbonate sheets and modules were separated by a bonding layer of TPU (f), laminated as follows:

¼" (0.6 cm) polycarbonate sheet (a)
0.050 (1.3 mm) TPU membrane (f)
metal fabric module (c)
0.050 (1.3 mm) TPU membrane (f)
aramid sheet module (c)
0.050 (1.3 mm) TPU membrane (f)
metal fabric module (c)
0.050 (1.3 mm) TPU membrane (f)
aramid sheet module (c)
0.050 (1.3 mm) TPU membrane (f)
metal fabric module (c)
0.050 (1.3 mm) TPU membrane (f)
aramid sheet module (c)
0.050 (1.3 mm) TPU membrane (f)
½" (1.3 cm) polycarbonate sheet (a)

6. Thermoplastic Resin Ballistic Resistant Laminate Panel

A ballistic resistant, fragmentation debris capture laminate panel of the present invention was constructed of thermoplastic ballistic resistant materials to meet the NIJ Type I rating which panel comprised a first polycarbonate sheet (a), a TPU bonding membrane (f), a second polycarbonate sheet (a), a second TPU bonding membrane (f), and a third polycarbonate sheet.

It will be recognized that these examples are illustrative only, and not intended in any way to limit the possible embodiments of the present invention, which are limited only by the desired protective performance characteristics, and visual design requirements, and budget of the user.

What is claimed is:

1. A ballistic resistant, fragmentation debris capture laminate panel having a plurality of layers comprising:

at least one thermoplastic resin sheet wherein the at least one thermoplastic resin sheet is PETG, at least one additional ballistic resistant material wherein the at least one additional ballistic resistant material is selected from the group consisting of a thermoplastic resin sheet, a metal fabric, a ballistic ceramic material, and an aramid fiber sheet, wherein the ballistic resistant, fragmentation debris capture laminate panel satisfies at least one ballistic resistance rating from at least one ballistic standard selected from the group consisting of standards ASTM F-1233, DIN EN 1063, HPW-TP 0500.02, MIL-662F 1997, NIJ 0108.01, and UL 752, and wherein the at least one ballistic resistance rating is selected from ratings applicable to ammunition selected from the group 7.62, 5.56 and 30.06.

2. A ballistic resistant, fragmentation debris capture laminate panel of claim 1 wherein the at least one additional ballistic resistant material is a first metal fabric.

3. A ballistic resistant, fragmentation debris capture laminate panel of claim 2 wherein the metal fabric is a coiled wire mesh possessing a weave of between 3/32 inches (0.2 cm) and 5/8 inches (1.6 cm) and wire in corresponding gauges of between 20 and 15 (diameters of between 0.0318" (0.8 mm) and 0.08" (2.0 mm)).

4. A ballistic resistant, fragmentation debris capture laminate panel of claim 2 wherein the at least one additional ballistic resistant material further comprises at least a second or more additional metal fabric oriented in a plane parallel to the first and having an orientation wherein the weave is the same as the orientation of the weave of the first metal fabric.

5. A ballistic resistant, fragmentation debris capture laminate panel of claim 1 wherein the at least one additional ballistic resistant material is a thermoplastic resin architectural panel having a decorative element.

6. A ballistic resistant, fragmentation debris capture laminate panel of claim 2 wherein the at least one additional ballistic resistant materials further comprises at least a second or more metal fabric oriented in a plane parallel to the first and having an orientation wherein the weave is rotated between 1 and 90 degrees in relation to the weave of the first metal fabric.

7. A ballistic resistant, fragmentation debris capture laminate panel of claim 1 wherein at least a first thermoplastic resin sheet, the at least one additional ballistic resistant material, and a second thermoplastic resin sheet are bonded to form a module.

8. A ballistic resistant, fragmentation debris capture laminate panel of claim 7 having a plurality of modules.

9. A ballistic resistant, fragmentation debris capture laminate panel of claim 8 wherein the at least one additional ballistic resistant material of a module is a metal fabric, wherein the metal fabric is a coiled wire mesh.

10. A ballistic resistant, fragmentation debris capture laminate panel of claim 9 wherein the panel comprises the following layers: a first 0.6 cm polycarbonate sheet, a series of six modules wherein the first and second thermoplastic resin sheet of each module is PETG, and wherein in the first, third and fifth modules the additional ballistic resistant material is a coiled wire mesh, and wherein in the second, fourth and sixth modules the additional ballistic resistant material is an aramid fiber, and a second 0.6 cm polycarbonate sheet, and wherein the panel is selected to satisfy at least one ballistic resistance rating of the 7.62, 5.56 and 30.06 ammunition ballistic standards from the group of ballistic resistance ratings consisting of:

for 7.62 the following: NIJ 018.01 Type III, EURO DIN EN 1063 BR6 7.62 X 51 NATO, ASTM F1233 7.62 NATO, HPW-TP 0500.02 D 7.62 X 51, UL 752 Level 5, and UL 752 Level 8, for 5.56: EURO DIN EN 1063 BR5 5.56 X 45 NATO AP, and UL 752 Level 7, and for 30.06: NIJ 018.01 Type IV, UL 752 Level 4, and UL 752 Level 9.

11. A ballistic resistant, fragmentation debris capture laminate panel of claim 9 wherein the panel comprises a first 1.3 cm polycarbonate sheet, a series of at least two modules, and a second 1.3 cm polycarbonate sheet, wherein the first and second thermoplastic resin of each module is PETG, wherein the at least one additional ballistic resistant material of a module is two coiled wire mesh, namely a first coiled wire mesh and a second coiled wire mesh.

12. A ballistic resistant, fragmentation debris capture laminate panel of claim 11 wherein the panel comprises a first 1.3 cm polycarbonate sheet, a series of four modules, namely a first module, a second module, a third module and a fourth module, and a second 1.3 cm polycarbonate sheet, wherein the first and second thermoplastic resin of each module is PETG, wherein the at least one additional ballistic resistant material of the first module is two coiled wire mesh, namely a first coiled wire mesh and a second coiled wire mesh, wherein in the second module and fourth module, the second coiled wire mesh is oriented at an angle between 1 and 90 degrees offset from the orientation of the first coiled wire mesh, and wherein the panel is selected to satisfy at least one ballistic resistance rating of the 7.62 and 30.06 ammunition ballistic standards from the group of ballistic resistance ratings consisting of:

for 7.62 the following: NIJ 018.01 Type III, EURO DIN EN 1063 BR6 7.62 X 51 NATO, ASTM F1233 7.62 NATO, HPW-TP 0500.02 D 7.62 X 51, UL 752 Level 5, and UL 752 Level 8, and for 30.06: NIJ 018.01 Type IV, UL 752 Level 4, and UL 752 Level 9.

13. A ballistic resistant, fragmentation debris capture laminate panel of claim 11 wherein the panel comprises a first 1.3 cm polycarbonate sheet, a series of four modules, namely a first module, a second module, a third module and a fourth module, and a second 1.3 cm polycarbonate sheet, wherein the first and second thermoplastic resin of each module is PETG, wherein the at least one additional ballistic resistant material of a first module is two coiled wire mesh, namely a first coiled wire mesh and a second coiled wire mesh, wherein in the second module and fourth module, the second coiled wire mesh is oriented 45 degrees offset from the orientation of the first coiled wire mesh, and wherein the panel is selected to satisfy at least one ballistic resistance rating of the 7.62 and 30.06 ammunition ballistic standards from the group of ballistic resistance ratings consisting of:

for 7.62 the following: NIJ 018.01 Type III, EURO DIN EN 1063 BR6 7.62 X 51 NATO, ASTM F1233 7.62 NATO, HPW-TP 0500.02 D 7.62 X 51, UL 752 Level 5, and UL 752 Level 8, and for 30.06: NIJ 018.01 Type IV, UL 752 Level 4, and UL 752 Level 9.

* * * * *